US009528204B2

(12) United States Patent
King et al.

(10) Patent No.: US 9,528,204 B2
(45) Date of Patent: Dec. 27, 2016

(54) SURVIVALIST KERNMANTLE

(71) Applicants: Jarod Lee King, Ceres, CA (US); Shannon Melissa King, Ceres, CA (US)

(72) Inventors: Jarod Lee King, Ceres, CA (US); Shannon Melissa King, Ceres, CA (US)

( * ) Notice: Subject to any disclaimer, the term of this patent is extended or adjusted under 35 U.S.C. 154(b) by 127 days.

(21) Appl. No.: 14/604,718

(22) Filed: Jan. 24, 2015

(65) Prior Publication Data

US 2015/0128643 A1 May 14, 2015

(51) Int. Cl.

*D04C 1/12* (2006.01)
*A44C 5/00* (2006.01)
*D04D 1/02* (2006.01)

(52) U.S. Cl.

CPC ..... *D04C 1/12* (2013.01); *A44C 5/0007* (2013.01); *A44C 5/0053* (2013.01); *D04D 1/02* (2013.01)

(58) Field of Classification Search

CPC ..... A44C 5/0007; A44C 5/0053; D04D 1/02; D04C 1/12

See application file for complete search history.

(56) References Cited

U.S. PATENT DOCUMENTS 8,925,348 B2 * 1/2015 Gagne ..... A44C 5/0007 63/1.12
9,021,664 B2 * 5/2015 Ingalls ..... F16G 11/00 24/115 R
9,084,455 B2 * 7/2015 Millan ..... B26B 9/00
2012/0159987 A1 6/2012 Walchle
2013/0031935 A1 2/2013 Kelleghan
2013/0189631 A1 * 7/2013 Mojica ..... F23Q 1/06 431/274
2013/0213089 A1 * 8/2013 Gagne ..... A44C 5/0007 63/1.12
2014/0026371 A1 * 1/2014 Ingalls ..... F16G 11/00 24/115 R
2015/0282571 A1 * 10/2015 Gendron ..... A44C 5/0007 206/372
2016/0166012 A1 * 6/2016 Mojica ..... A44B 11/005 24/591.1

OTHER PUBLICATIONS http://gearward.com/products/fire-cord , Sep. 2014.*

(Continued)

*Primary Examiner* — Shaun R Hurley

(74) *Attorney, Agent, or Firm* — Richard B. Main; Main Law Cafe

(57) ABSTRACT

An improved kernmantle cord in part comprises 550-Paracord manufactured to exceed MIL-STD-C-5040H Type III. The improved kern at the core includes three nylon fibers in each of seven yarns, one continuous filament of waterproofed paraffin-waxed jute twine fiber tinder, one continuous abrasion-resistant nylon or fluorocarbon monofilament, and one continuous copper wire. The monofilament is strong enough for 50# test, yet small enough not to adversely impact the pliability of the cord as a whole. The copper wire itself may be multistrand or braided to improve flexibility or solid to provide more body. The mantle sheathing is of woven nylon and provides abrasion resistance for the whole cord, and functions as an electrical insulator for the copper wire and fireproofing for the paraffin-waxed jute twine fiber tinder.

10 Claims, 2 Drawing Sheets

(56) References Cited

OTHER PUBLICATIONS

Figure 1:
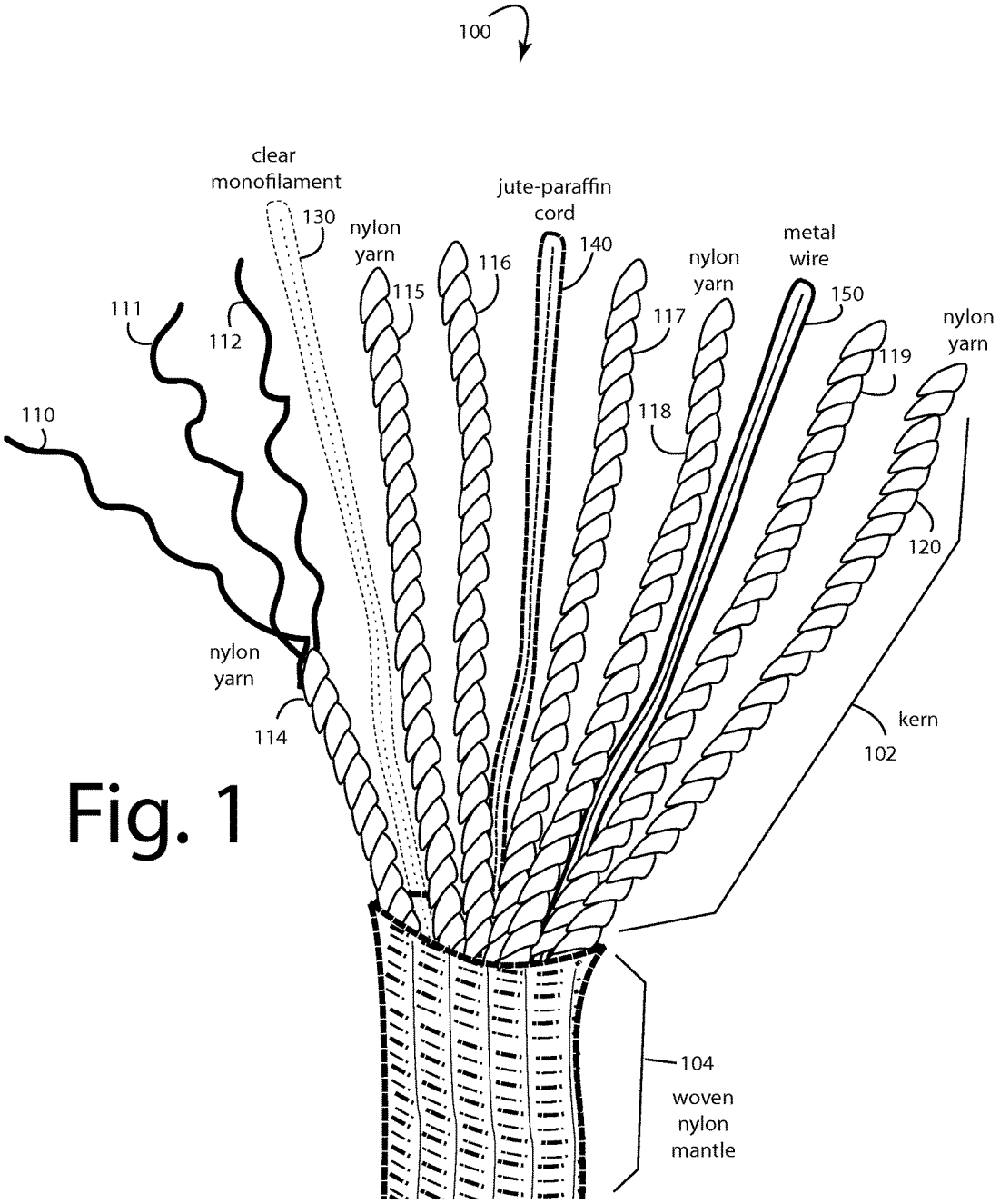

550 FireCord www.livefiregearllc.com, 2015.
The Kodiak: Re-defining survival by Janathan Price & Michael Mojica—Kickstarter, 2015.
Live Fire Gear LLC www.livefiregearllc.com, 2015.
About Outdoor Element.com / About OE Survival Paracord Bracelet 2015.
Paracord Bracelet Kit www.keepshooting.com, 2015.
6 Emergency Uses for Paracord www.prepforshtf.com, 2015.
Paracord Bracelets http://survivalstraps.com, 2015.
The Unlucky Hunter: Jute—Another Great Natural Tinder www.unluckyhunter.com, 2015.

* cited by examiner

SURVIVALIST KERNMANTLE

1. FIELD OF THE INVENTION

The present invention relates to survivalist gear, and more particularly to a small diameter kernmantle cord that includes a jute twine fire tinder, a monofilament fishing line, and a copper wire all inside a paracord for ingenious use by resourceful adventurers.

2. DESCRIPTION OF THE PRIOR ART

Some items have found uses over the years that went far beyond the original purposes and expectations of their inventors. The laser, the GPS navigation system, and aircraft are large examples of this. Necessity often is the mother of invention. Small everyday objects can be applied in surprising ways, all it takes is imagination and ingenuity. Bubblegum for example can be used to stick things together or plug leaks. Bobby pins are well known lock picks. Candles can be used for slow burning fuses. Duct Tape has a thousand uses as tourniquets, bandages, marking a trail, making spears, tent repair, handcuffs, car body repair, feet wrappings, blindfolds, mouth gags, sail repair, etc.

Survivalists and outdoor adventurers make conscious efforts to equip themselves with what they will need to survive in the wild. Some problems they will encounter are easy to expect, others will be surprises and therefore unwelcomed challenges, especially if they're not equipped to deal with the issues. First aid kits are a common way to prepare and equip for a variety of small medical emergencies. The spare tires, bumper jacks, and lug wrenches in cars are another way for motorists to get themselves out of trouble on the road.

So-called "550-Paracord" is a small diameter, very flexible synthetic-fiber (nylon/polyester) rope that has found wide appeal because of its many surprising uses, e.g., zipper pulls, handles, keychains, bracelets, lanyards and emergency lashing. The "550" implies it has a breaking strength of 550-pounds. Other ratings are also in popular use. These all have a "kernmantle" construction which is German for a woven outer sheath with a core inside of twisted inner yarns of continuous fiber.

It was originally used for the downward suspension cords in military grade parachutes, and so many 550-Paracords are offered in a MIL-STD-C-5040H grades and even quality commercial grades. The braided sheaths have a high number of interwoven strands for their rope size, making for a relatively smooth texture. All-nylon construction makes 550-Paracord moderately elastic. Genuine MIL-SPEC MIL-C-5040 Type III Paracord has 7-9 inner yarns each of up three strands.

Technical Standard MIL-C-5040H

| Type | Minimum strength | Minimum elongation | Minimum length per pound | Core yarns | Sheath structure |
|---|---|---|---|---|---|
| I | 95 lb (43 kg) | 30% | 950 ft (290 m; max. 1.57 g/m) | 1 | 16/1 |
| IA | 100 lb (45 kg) | 30% | 1050 ft (320 m; max. 1.42 g/m) | <no core> | 16/1 |
| II | 400 lb (181 kg) | 30% | 265 ft (81 m; max. 5.62 g/m) | 4 to 7 | 32/1 or 36/1 |
| IIA | 225 lb (102 kg) | 30% | 495 ft (151 m; max. 3.00 g/m) | <no core> | 32/1 or 36/1 |

-continued

| Type | Minimum strength | Minimum elongation | Minimum length per pound | Core yarns | Sheath structure |
|---|---|---|---|---|---|
| III | 550 lb (249 kg) | 30% | 225 ft (69 m; max. 6.61 g/m) | 7 to 9 | 32/1 or 36/1 |
| IV | 750 lb (340 kg) | 30% | 165 ft (50 m; max. 9.02 g/m) | 11 | 32/1, 36/1, or 44/1 |

Paracord Bracelets are now very popular amongst "preppers" who see it to be important to have a basic toolkit of gear always with them. Paracord is even being woven into belts and rifle slings, ready to be used when least expected.

The yarns of 550-Paracord, "the guts", can be removed when a finer string is needed, for instance as sewing thread to repair gear, or (some suggest) as fishing line in a survival situation. The nylon sheath can be used alone after the yarn in the core is removed when a thinner or less elastic cord is needed for boot lace and similar needs. The naturally frizzy ends of the cord are habitually melted with a match and hot-crimped to prevent excessive unraveling.

One commercial product, the 550-FireCord™, advertises "Simply deploy your 550 FireCord to meet all of your parachute cord needs . . . . When you need the fire tinder, remove the inner strands, light just like any fire tinder and build your fire . . . . After the inner strands are used, the outer shell can be reused like before, for lanyards, keychains, zipper pulls, or emergency lashing."

Some paracord is suggested for use as fishing line, but not being clear and transparent such will usually scare the fish away from the bait and hook.

SUMMARY OF THE INVENTION

Briefly, a kernmantle cord embodiment of the present invention comprises an improved 550-Paracord manufactured to exceed MIL-STD-C-5040H Type III. The kern at the core comprises three nylon fibers in each of seven yarns, one continuous filament of waterproofed paraffin-waxed jute twine fiber tinder, one continuous abrasion-resistant nylon or fluorocarbon monofilament, and one continuous copper wire. The monofilament is strong enough for 50# test, yet thin enough not to adversely impact the pliability of the cord as a whole. The copper wire itself may be multistrand or braided to improve flexibility, or solid to provide more body. The mantle sheathing is of woven nylon and provides abrasion resistance for the whole cord, and functions as an electrical insulator for the copper wire and fireproofing for the paraffin-waxed jute twine fiber tinder.

These and other objects and advantages of the present invention no doubt become obvious to those of ordinary skill in the art after having read the following detailed description of the preferred embodiments which are illustrated in the various drawing figures.

IN THE DRAWINGS

Figure 2:
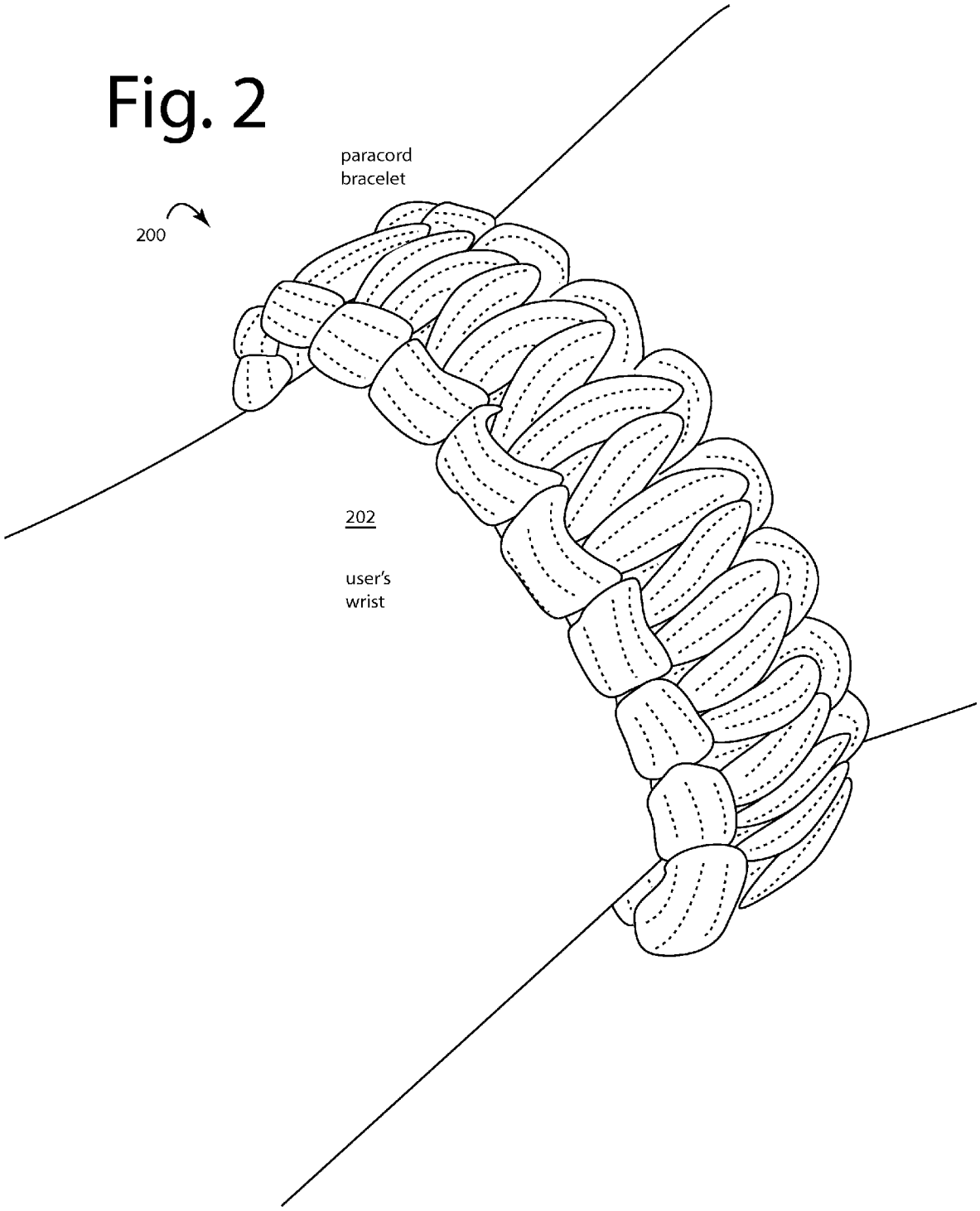

FIG. 1 is a perspective view diagram of an improved kernmantle cord of the present invention; and FIG. 2 is a paracord bracelet embodiment of the present invention that has been woven from a single strand of the improved kernmantle cord of FIG. 1.

DETAILED DESCRIPTION OF THE PREFERRED EMBODIMENT

FIG. 1 represents a kernmantle cord embodiment of the present invention, and is referred to herein by the general reference numeral 100. Kernmantle cord 100 comprises an improved 550-Paracord manufactured to exceed MIL-STD-C-5040H Type III.

A kern 102 at the core is protected from the environment inside a mantle 104. Conventional kernmantle cords use synthetic threads like nylon and polyester for these pieces. Here, three nylon fibers 110-112 are twisted into each of seven full-length yarns 114-120. Seven such full-length yarns 114-120 suits MIL-STD-C-5040H Types II and III, other types are possible depending on the intended applications.

Technical Standard MIL-C-5040H

| Type | Minimum strength | Minimum elongation | Minimum length per pound | Core yarns | Sheath structure |
|---|---|---|---|---|---|
| I | 95 lb (43 kg) | 30% | 950 ft (290 m; max. 1.57 g/m) | 1 | 16/1 |
| IA | 100 lb (45 kg) | 30% | 1050 ft (320 m; max. 1.42 g/m) | <no core> | 16/1 |
| II | 400 lb (181 kg) | 30% | 265 ft (81 m; max. 5.62 g/m) | 4 to 7 | 32/1 or 36/1 |
| IIA | 225 lb (102 kg) | 30% | 495 ft (151 m; max. 3.00 g/m) | <no core> | 32/1 or 36/1 |
| III | 550 lb (249 kg) | 30% | 225 ft (69 m; max. 6.61 g/m) | 7 to 9 | 32/1 or 36/1 |
| IV | 750 lb (340 kg) | 30% | 165 ft (50 m; max. 9.02 g/m) | 11 | 32/1, 36/1, or 44/1 |

Types IA and IIA are essentially mantles without the kern and so are not types subject to the improvements of the present invention. The Parachute Industry Association promulgates and actively maintains a similar specification called PIA-C-5040. It essentially mirrors MIL-C-5040 which has become obsolete.

Mantle 104 represents an improved woven synthetic-thread mantle sheathing that is widened over conventional constructions and supplemented with additional threads. Such allows the improved mantle 104 to accommodate all the longitudinal elements of the entire kern 102 without significant gaps appearing in the mantle sheathing. This further provides for environmental protection from abrasion while remaining substantially pliable.

Embodiments of the present invention improve over conventional paracords by further incorporating a continuous, abrasion-resistant, and clear nylon or fluorocarbon monofilament 130. One continuous thread 140 of waterproofed paraffin-waxed jute twine fiber is included for use as tinder to start campfires and cooking fires. It can also be used as a makeshift candle.

Alternative embodiments of the present invention further require the inclusion of a metal wire 150, e.g., in solid core, stranded, or braided forms no more than one millimeter in diameter. Some metals are believed to have medicinal purposes, like copper bracelets worn for arthritis and joint pain. There are seven metals in the ancient alchemical system of healing: gold, silver, mercury, copper, iron, tin, and lead. (Mercury itself cannot be made into wire, and exposure to it and lead can be poisonous.)

Being made of metal, most metal wires are good electrical conductors. They also can make excellent radio antennas and waveguides. A section passed through a hole in an outside wall of a collapsed building can couple radio communications between the inside and outside.

Various kinds of metal like copper, brass, aluminum, silver, stainless steel, and iron, can be easily made into wire and each kind has its own useful properties. Gold and stainless steel do not corrode. Gold and copper wires are very flexible and good electrical conductors. Lead wire can be used as a solder. Stainless steel wire could be used to hang food for cooking in fires. Of all the choices, copper wire seems to have the most appeal and usefulness to users of embodiments of the present invention.

A continuous copper wire can be employed to serve as an electric burner or igniter if a small battery is available. The copper wire 150 is alloyed and sized in such case to have an electrical resistance in a range that will heat to an ignition temperature for cellulose when less than 12" of its length is connected to a battery less than or nominally equal to 12-volts. The heating effects can be concentrated at a center point by doubling or tripling up the wire by folding and twisting so that only a single strand bridges the midsection. Such would also make connecting the battery safer because the leads would not get so hot.

Monofilament 130 is in one embodiment strong enough for 50# test, yet thin enough not to adversely impact the pliability of the cord 100 as a whole.

The mantle 104 sheathing is of woven nylon and provides abrasion resistance for the whole cord, and secondarily functions as an electrical insulator for the copper wire 150 and as a fire-retardant for the paraffin-waxed jute twine fiber tinder cord 140. Frayed and fluffed dry jute is highly flammable. Paraffin wax is used in candles and will help the jute stay dry and adds to the flammability when it melts and vaporizes at a flash point of 390° F.

Fluorocarbon monofilament 130 works best in clear water situations or when "line stretch" is undesirable. Very little stretch transmits fish strikes better and allows for stronger hook-sets. Fluorocarbon monofilaments have the best abrasion resistance, but tend to have problems with memory and "stiffness". They are not cheap, and many use it as a leader material.

With a 50# Test to monofilament 130, a survivor can reasonably expect to succeed in catching anything from fresh-water perch to heavy sea bass. 50# Test is strong enough to be useful, yet light enough not to significantly influence the pliability of 555-Paracord 100.

For the jute twine 140, a string diameter of about 1-2 millimeters seems to provide enough material that it can be scraped, flattened, roughed up, and succeed as tinder without adding too much bulk to 555-Paracord 100. Jute is essentially cellulose and is biodegradable, however it can promote and feed molds and mildew if wet. Jute is also photochemical degradable when exposed to ultraviolet. Jute burns because cell wall polymers undergo pyrolysis reactions and give off flammable gases. Biological resistance can be added by using wood preservatives or by keeping moisture content low, a side benefit of waterproofing it with paraffin wax.

In most cases, the goal is to keep the cord pliable so that it can be easily used in crafts. If 555-Paracord 100 was permitted to get so large as to be unmanageable, no one would use it in their survival crafts. In such case it won't be available in a survival situation.

Improved 550-Paracord embodiments of the present invention provide the basic materials needed for ingenious use by resourceful adventurers to catch fish to cook and eat for survival. Many kinds of fishing methods from rod-and-reel, to fly fishing, to netting, and snaring are known and have been successfully used for thousands of years. These embodiments allow for fast immediate use without undue preparation of the basic gear.

Fly fishing gear setup includes the fly rod, fly reel, fly line, and flies. The fly fishing leader and tippet provide a nearly invisible transition from the fly line to the fly. Fly fishing leaders and tippets come in a wide variety of shapes, sizes, materials, and even colors. A main purpose of the leader and tippet is to connect thick, colored fly lines used for casting to the flies that are presented to the fish, using a material that won't scare them away. They further complete a transfer of energy in the fly line through the casting stroke through the line and down to the fly so that the line rolls over and straightens itself out into a straight line.

Commercial leader and tippet manufacturers have produced a wide assortment of products. There is a difference between fly fishing leaders and tippets. The clear material of the leader is connected to the end of the fly line and is a fairly heavy weight where it attaches. It often will taper down in weight and thickness to a point for the tippet to attach. The leader is pretty much the same as fishing monofilament used on spinning and casting reels.

The section of the leader that attaches to the fly line is generally on the heavy side of the pound test rating, and is called the butt section. Many anglers start with a twenty pound test butt section of leader to attach to the fly line, and taper down to around four pound test. The leader, on average, will be about nine feet long.

The fly fishing tippet is the lightweight portion of material that is attached to the fly. The lightest, yet strongest, tippet possible is required to keep the fish from noticing it. Generally the same leader section can be used with changes to the tippet size, depending on the nature of the fishing and the situation.

The typical length to use when learning how to fly fish is around ten feet. The goal with a leader setup is to create a taper from the butt section down to an as-thin-as-possible tippet section. Such allows the energy from the fly line to transfer as efficiently as possible through the leader and tippet to straighten out as the cast lands on the water surface.

Starting out with a twenty pound test leader material attached to the fly line and tapering down, the last couple feet of material will have the tippet attached. This arrangement provides the best way to deceive fish that anything is attached to the fly.

Several people have publically suggested on the Internet ways to make the fishing flies themselves out of paracord. Flies are a necessity when no bait is available. But all these clever suggestions seem to require a fishing hook. A solid copper wire 150 included in the kern of our improved 550-Paracord 100 can be used to help fashion a suitable fishing hook, certainly for smaller fish.

Dissimilar materials and filaments in the kern will have different elasticity and stretch. This is not expected to be of any concern with the short lengths involved with survival bracelets where there is no stress ever applied. Its first use would normally to pull it apart to cannibalize the constituent filaments in the kern.

In general, improved kernmantle cord embodiments of the present invention comprise an improved kern of at least: (1) a plurality synthetic thread fibers braided into a parallel number of yarns that principally make up a core; (2) a continuous full-length strand of jute twine fiber tinder waterproofed with paraffin-wax and added to said core; (3) a continuous full-length strand of abrasion-resistant and visually clear nylon or fluorocarbon monofilament and added to said core. Such improved kern is covered by an improved woven-thread mantle sheathing that is widened and supplemented along its continuous full-length with additional threads to accommodate a relatively larger diameter of the improved kern. It does so without leaving any significant gaps between threads in the mantle sheathing that would otherwise expose or allow parts of the improved kern to extrude. The improved woven mantle sheathing further provides for electrical insulation, abrasion resistance, and other environmental protection of the improved kern and pliability of the whole.

FIG. 2 represents a paracord survival bracelet 200 in an embodiment of the present invention that has been looped, knotted, tied, and otherwise woven from a single strand of the improved kernmantle cord 100 (FIG. 1). Many people believe that wearing copper on one's wrists will give some relief from joint pain and other health benefits. Here, the paracord survival bracelet 200 is shown as it would be typically worn on a user's wrist 202.

Although the present invention has been described in terms of the presently preferred embodiments, it is to be understood that the disclosure is not to be interpreted as limiting. Various alterations and modifications no doubt become apparent to those skilled in the art after having read the above disclosure. Accordingly, it is intended that the appended claims be interpreted as covering all alterations and modifications as fall within the "true" spirit and scope of the invention.

What is claimed is:

1. An improved kernmantle cord, the improvements comprising:

an improved kern that includes:

a plurality synthetic thread fibers braided into a parallel number of yarns that principally make up a core;

a continuous full-length strand of jute twine fiber tinder waterproofed with paraffin-wax and added to said core;

a continuous full-length strand of abrasion-resistant and clear and transparent nylon or fluorocarbon monofilament and added to said core; and an improved woven-thread mantle sheathing that is widened and supplemented along its continuous full-length and that accommodates additional threads that increase the diameter of the improved kern, and without significant gaps between threads in the mantle sheathing that would otherwise expose or allow parts of the improved kern to extrude, and environmental protection from abrasion and pliability of the improved kern.

2. The improved kernmantle cord of claim 1, further comprising and disposed with the kern and fully within the mantle:

a continuous metal wire that runs inside the full-length of the improved woven mantle sheathing;

wherein the mantle further provides electrical insulation for the continuous metal wire.

3. The improved kernmantle cord of claim 2, further comprising and disposed with the kern and fully within the mantle:

a plastic coating applied to the surface of the continuous metal wire, and protecting the material from corrosion, and for mitigating any wire breaks;

wherein the plastic coating further provides a degree of electrical insulation for the continuous metal wire.

4. The improved kernmantle cord of claim 2, wherein:

the continuous metal wire comprises an alloy and sized to have an electrical resistance in a range that will heat to an ignition temperature for cellulose when less than 12" of its length is connected to a battery less than or nominally equal to 12-volts.

5. The improved kernmantle cord of claim 2, wherein:

the continuous metal wire is a type that is braided or stranded for pliability and flexibility.

6. The improved kernmantle cord of claim 2, wherein:

the continuous metal wire has a single solid core that significantly reduces the overall pliability and flexibility of the improved kernmantle cord.

7. The improved kernmantle cord of claim 2, wherein:

the abrasion-resistant and transparent nylon or fluorocarbon monofilament has at least a fifty pound test rating.

8. The improved kernmantle cord of claim 2, wherein:

the filament of jute twine fiber tinder waterproofed with paraffin-wax is no more than two millimeters in outside diameter.

9. An improved kernmantle cord of 550-Paracord, the improvement comprising:

a kern at the core that includes:

a plurality of synthetic fibers twisted into each of several full-length yarns;

a continuous filament of jute twine fiber tinder waterproofed with paraffin-wax and not exceeding two millimeters in diameter;

a continuous abrasion-resistant and clear and transparent nylon or fluorocarbon monofilament with at least a fifty pound test rating;

a continuous length of metal wire not exceeding one millimeter in diameter;

a plastic coating applied to the surface of the metal wire, and protecting the metal material from corrosion, and for mitigating any wire breaks, wherein the plastic coating further provides a degree of electrical insulation for the continuous length of metal wire; and an improved woven synthetic-thread mantle sheathing that includes synthetic threads disposed within that accommodate all longitudinal elements of the entire kern without leaving significant gaps in the mantle sheathing, and afford abrasion protection and pliability;

wherein the mantle further provides additional electrical insulation for the metal wire.

10. A paracord, comprising:

at least one strand adapted for fire-starting and tindering;

at least one strand adapted for inclusion in a fishing line, leader, and tippet;

a number of strands in combination adapted for roping with at least a 550-pound breaking strength; and a single woven covering that sheaths the above together into a single pliable cord;

a single length of the whole is twisted, looped, knotted, and otherwise fashioned into a bracelet adaptable to the wrist of a user; and a strand of metal wire included within said single length.

* * * * *